US007799103B2

(12) United States Patent
Coburn

(10) Patent No.: US 7,799,103 B2
(45) Date of Patent: Sep. 21, 2010

(54) FILTER CLEANING MECHANISMS

(75) Inventor: Eric Coburn, Coxhoe (GB)

(73) Assignee: Black & Decker Inc., Newark, DE (US)

( * ) Notice: Subject to any disclaimer, the term of this patent is extended or adjusted under 35 U.S.C. 154(b) by 280 days.

(21) Appl. No.: 12/080,493

(22) Filed: Apr. 3, 2008

(65) Prior Publication Data

US 2008/0250601 A1 Oct. 16, 2008

(30) Foreign Application Priority Data

Apr. 4, 2007 (EP) ..... 07105676

(51) Int. Cl.
*A47L 9/20* (2006.01)
*B01D 46/04* (2006.01)

(52) U.S. Cl. ..... 55/304; 55/305; 55/487; 55/DIG. 3; 15/352

(58) Field of Classification Search ..... 55/301, 55/304, 305, 433, 475, 487, 300, DIG. 3; 210/350; 95/278, 282; 15/344, 347, 352
See application file for complete search history.

(56) References Cited

U.S. PATENT DOCUMENTS

| | | | | |
|---|---|---|---|---|
| 3,708,962 | A * | 1/1973 | Deguchi et al. | 55/300 |
| 4,199,334 | A * | 4/1980 | Berkhoel | 55/304 |
| 4,443,235 | A * | 4/1984 | Brenholt et al. | 96/408 |
| D275,427 | S | 9/1984 | Kishi et al. | |
| D302,876 | S | 8/1989 | Ikeda et al. | |
| D337,303 | S | 7/1993 | Naft et al. | |
| D357,772 | S | 4/1995 | Yuen | |
| 5,565,012 | A * | 10/1996 | Buodd | 55/294 |
| D398,425 | S | 9/1998 | Hudson | |
| D401,021 | S | 11/1998 | Stephens et al. | |
| D435,707 | S | 12/2000 | Leung | |
| D441,926 | S | 5/2001 | Stratford | |
| D448,894 | S | 10/2001 | Yuen | |
| D456,960 | S | 5/2002 | Vandenbelt et al. | |
| D466,476 | S | 12/2002 | Stratford | |
| 6,493,903 | B1 | 12/2002 | Super | |
| D504,397 | S | 4/2005 | Lodato et al. | |
| D521,450 | S | 5/2006 | Stratford | |
| 7,419,520 | B2 * | 9/2008 | Lee et al. | 55/282 |
| 2005/0081321 | A1 | 4/2005 | Milligan et al. | |

(Continued)

*Primary Examiner*—Frank M Lawrence
(74) *Attorney, Agent, or Firm*—John Yun; Bruce S. Shapiro; Stephen Valancius

(57) ABSTRACT

In one aspect, the present invention provides a filter cleaning mechanism comprising: a filter material (37) for filtering out dust and dirt particles from air passing therethrough; a frame (32, 34, 35, 38, 39) for supporting said filter material (37); devices (31, 296; 25*a*, 25*b*, 25*c*, 25*d*) for mechanically agitating said filter material to dislodge dust and dirt particles therefrom; wherein the devices for mechanically agitating said filter material comprises elements (31, 296; 25*a*, 25*b*, 25*c*, 25*d*) for deforming said frame within its elastic limit and elements (31, 296; 25*a*, 25*b*, 25*c*, 25*d*) for rapidly releasing said frame from said deformation to cause said frame to relax to an undeformed state. The present invention also provides a hand-holdable vacuum cleaner comprising such a filter cleaning mechanism, as well as a method of cleaning a filter assembly (30) comprising a filter material (37) and a frame (32, 34, 35, 38, 39) for supporting said filter material (37), wherein the method comprises the steps of deforming the frame within its elastic limit and rapidly releasing the frame from said deformation, thereby causing the frame to relax to an undeformed state.

9 Claims, 9 Drawing Sheets

U.S. PATENT DOCUMENTS

2007/0226953 A1* 10/2007 Ohtsu et al. ..... 15/352
2009/0113662 A1* 5/2009 Pineschi ..... 15/347
2009/0144931 A1 6/2009 Milligan et al.

* cited by examiner

FILTER CLEANING MECHANISMS

FIELD OF THE INVENTION

This application claims priority to European Patent Application No. 07105676.6 filed Apr. 4, 2007. The entire contents of that application are expressly incorporated herein by reference.

BACKGROUND OF THE INVENTION

The present invention concerns filter cleaning mechanisms suitable for use in hand-holdable vacuum cleaners. Such vacuum cleaners are well known for collecting dust and dirt, although wet-and-dry variants which can additionally collect liquids are also known. Typically, hand-holdable vacuum cleaners are intended for use in a domestic environment, although they also find uses in other environments, such as worksites. Generally, they are electrically powered and therefore comprise an electric motor, an electrical on/off switch for a user to operate said motor, a fan connected to an output shaft of said motor, an inlet for dirty air, an outlet for clean air and a collection chamber for dust, dirt and possibly also liquids. Electrical power for the motor may be provided by a source of mains electricity, in which case the vacuum cleaner will further comprise an electrical power cable, by a removable and replaceable battery pack, or by one or more in-built rechargeable cells, in which case the vacuum cleaner will further comprise some means, such as a jack plug, for connecting the vacuum cleaner to a recharging unit. When the vacuum cleaner is provided with electrical power from one of these sources and the on/off switch is set to the "on" position, the electric motor drives the fan to draw dirty air along an airflow pathway in through the dirty air inlet, via the collection chamber to the clean air outlet.

BRIEF SUMMARY OF THE INVENTION

Interposed at some point along the airflow pathway, there is also provided some means for separating out dust and dirt (and possibly also liquids) entrained with the dirty air and depositing these in the collection chamber. This separation means may comprise one or more filters and/or a cyclonic separation device. However, in the event that the separation means comprises a filter, there is a risk that the filter material may become blocked with dust and dirt particles which adhere thereto, thereby lowering the rate of air movement (i.e. volume of air moved per unit time) through the vacuum cleaner by obstructing the airflow during operation of the vacuum cleaner and reducing the overall cleaning efficiency of the vacuum cleaner. Accordingly, in order to ensure its continued efficient operation, it is desirable to provide the vacuum cleaner with a filter cleaning mechanism. Such filter cleaning mechanisms are known in hand-holdable vacuum cleaners and an example of one is described in European patent publication no. EP 1 523 916 A, also in the name of the present applicant. However, such a filter cleaning mechanism as described in this prior art document, although not requiring any power to operate other than that supplied manually by a user and although also convenient to use as desired, suffers from the disadvantage that it involves mechanical rubbing of the filter material in order to agitate it and dislodge dust and dirt particles therefrom. This may have the undesirable consequence of shortening the lifespan of the filter material through wear and tear.

It is therefore an object of the present invention to provide a filter cleaning mechanism suitable for use in a hand-holdable vacuum cleaner which does not require mechanical rubbing of the filter material in order to dislodge dust and dirt particles therefrom. A further object of the present invention is to provide an improved manually operated filter cleaning mechanism suitable for use in a hand-holdable vacuum cleaner.

Accordingly, in one aspect, the present invention provides a filter cleaning mechanism comprising: a filter material for filtering out dust and dirt particles from air passing therethrough; a frame for supporting said filter material; means for mechanically agitating said filter material to dislodge dust and dirt particles therefrom; wherein the means for mechanically agitating said filter material comprises means for deforming the frame within its elastic limit and means for rapidly releasing the frame from said deformation to cause said frame to relax to an undeformed state. Thus, the deformation of the frame by the means for deforming it is transmitted to the filter material which is supported by the frame and the rapid release of the frame by the means for releasing it causes the filter material to be shaken, thereby dislodging dust and dirt particles therefrom without subjecting the filter material itself to direct mechanical impact or manipulation and thereby avoiding wear and tear on the filter material. The present invention also has the advantage that it may be used with both pleated and unpleated filter materials, since there is no requirement that the filter material should be pleated, which in some prior art filter cleaning mechanisms is necessary to provide surface irregularities on the filter material, direct rubbing of which causes the filter material to vibrate for the propose of dislodging dust and dirt particles therefrom.

In a second aspect, the present invention also provides a hand-holdable vacuum cleaner comprising such a filter cleaning mechanism.

In a further aspect, the present invention provides a method of cleaning a filter assembly comprising a filter material and a frame for supporting the filter material, the method comprising the steps of deforming the frame within its elastic limit and rapidly releasing the frame from said deformation, thereby causing the frame to relax to an undeformed state.

The deformation of the frame may be compressional, torsional, by stretching or by bending, or any combination of these various deformations. Preferably, the frame is deformed and released a plurality of times by providing a plurality of the means for deforming and releasing the frame. This has the advantage of increasing the amount of dust and dirt dislodged from the filter material in a single cleaning operation. If two or more arrangement of means for deforming and releasing the frame in different directions are provided, this has the advantage of increasing the amount of dust and dirt dislodged from the filter material in a single cleaning operation still further. Moreover, if there are two or more arrangements of means for deforming and releasing the frame in different directions, advantageously, each of them is composed of a plurality of means for deforming and releasing the frame which are separated from each other at regular intervals which are different between the different arrangements of means for deforming and releasing the frame, with the result that the frame, and hence the filter material, is agitated at two or more different frequencies during a single filter cleaning operation. The different frequencies affect different sizes of dust and dirt particles adhering to the filter material in different amounts, thereby increasing the total amount of dust and dirt dislodged from the filter material still further.

Preferably, the filter cleaning mechanism further comprises means for manually actuating the means for mechanically agitating the filter material in order to dislodge dust and dirt particles therefrom. This has the advantage of not requiring any electrical, pneumatic or other additional power supply to operate the filter cleaning mechanism and allows a user to actuate it as desired. In a preferred embodiment, the means for manually actuating the means for mechanically agitating the filter material comprises a mechanism for performing a filter cleaning operation in a single, first movement and for returning the filter cleaning mechanism to its starting position in a single second movement, for example by providing a lever, the down-stroke of which performs a filter cleaning operation and the up-stroke of which returns the filter cleaning mechanism to its starting position. This makes the filter cleaning mechanism particularly simple and convenient to use.

BRIEF DESCRIPTION OF THE INVENTION

Further features and advantages of the present invention will be better understood by reference to the following description, which is given by way of example and in association with the accompanying drawings, in which.

DETAILED DESCRIPTION OF THE INVENTION

Figure 1:
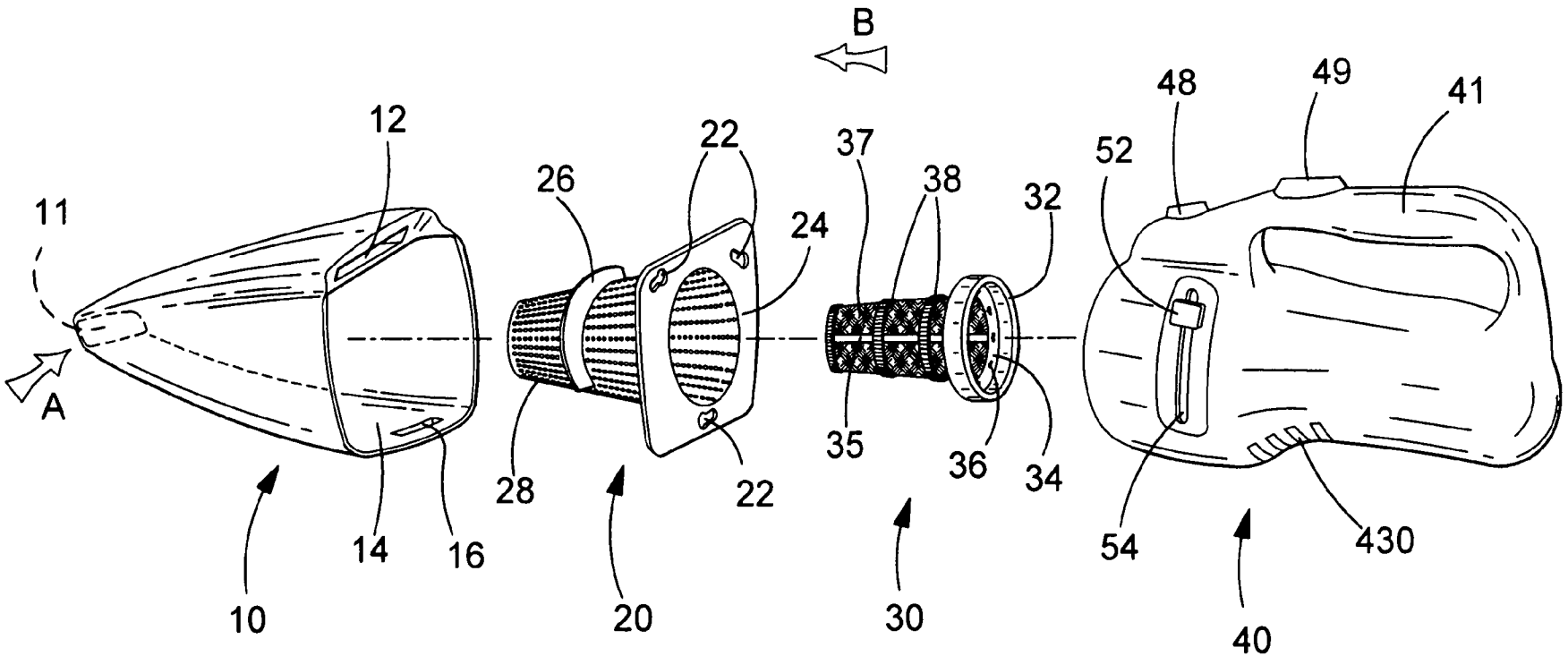
FIG. 1 is an exploded perspective view of the major components of a hand held vacuum cleaner according to an embodiment of the present invention.

Referring firstly to FIG. 1, there is shown an exploded perspective view of the major components of a hand held vacuum cleaner according to an embodiment of the invention, comprising a nose cone 10, a coarse filter assembly 20, a fine filter assembly 30 and a motor housing 40. Fine filter assembly 30 is contained entirely within coarse filter assembly 20, which in turn attaches to motor housing 40 via holes 22 formed in an end flange 24 of coarse filter assembly 20. Holes 22 respectively engage with corresponding lugs 42 (not visible in FIG. 1, but shown in FIG. 3 and described in greater detail below in relation thereto) formed on an end face of motor housing 40. Nose cone 10 then attaches to motor housing 40 in a releasable manner to enclose coarse filter assembly 20 and fine filter assembly 30 therein.

Figure 2:
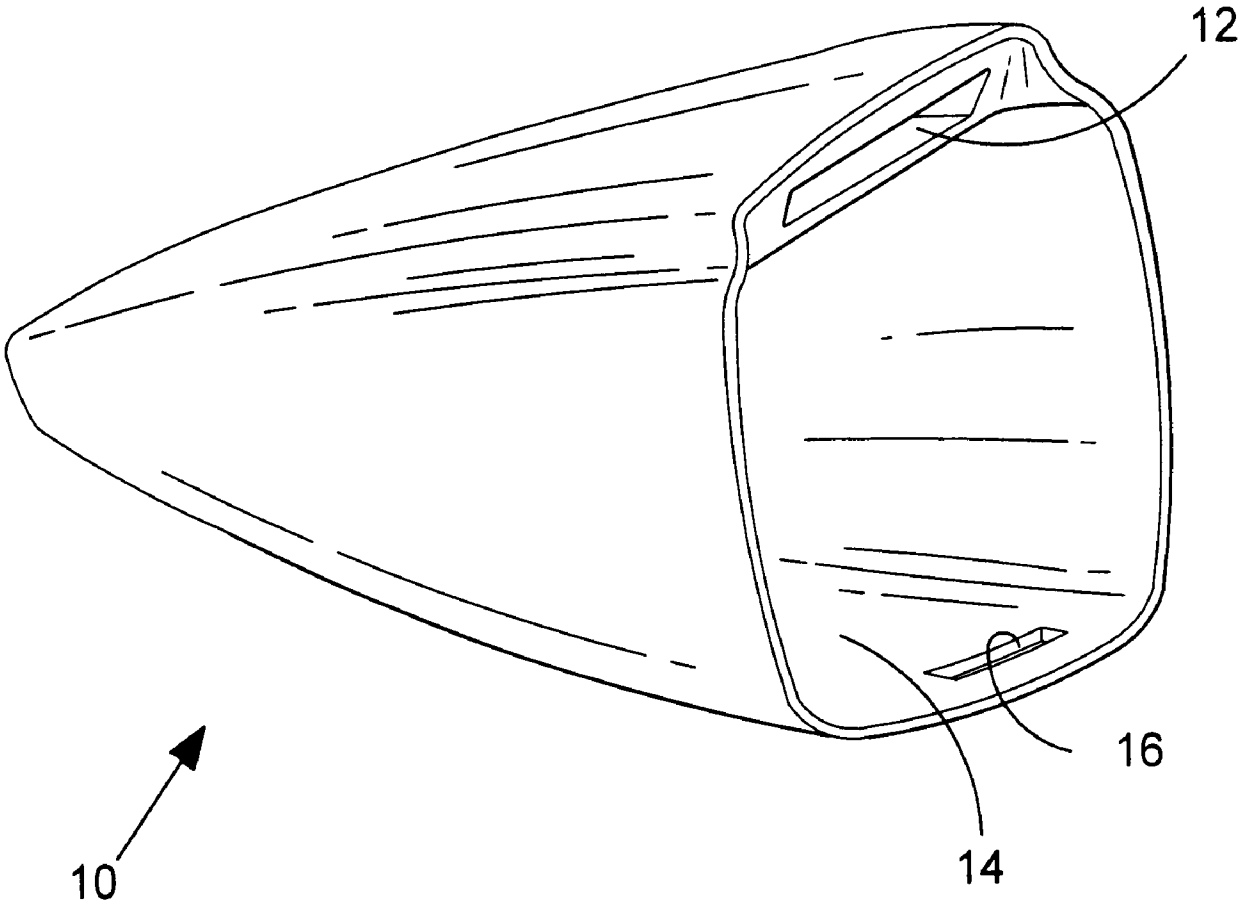
FIG. 2 is a perspective view of a nose cone of the hand held vacuum cleaner shown in FIG. 1.

In operation of the vacuum cleaner, dirty air enters the nose cone 10 in the direction indicated by arrow A in FIG. 1 via a dirty air inlet 11, travels along a duct built into the roof of nose cone 10 and exits the duct into a dust collection chamber 14 of nose cone 10 via an outlet 12. As can be seen in greater detail in FIG. 2, outlet 12 is located within nose cone 10 such that when the vacuum cleaner is assembled, dirty air exits outlet 12 between the end flange 24 of coarse filter assembly 20 and a deflector 26 also built integrally into outer surface 28 of coarse filter assembly 20. End flange 24 and deflector 26 therefore tend to direct the flow of air entering dust collection chamber 14 in a circumferential direction around the main body 28 of coarse filter assembly 20 anticlockwise when viewed from the direction of arrow B in FIG. 1.

Figure 3:
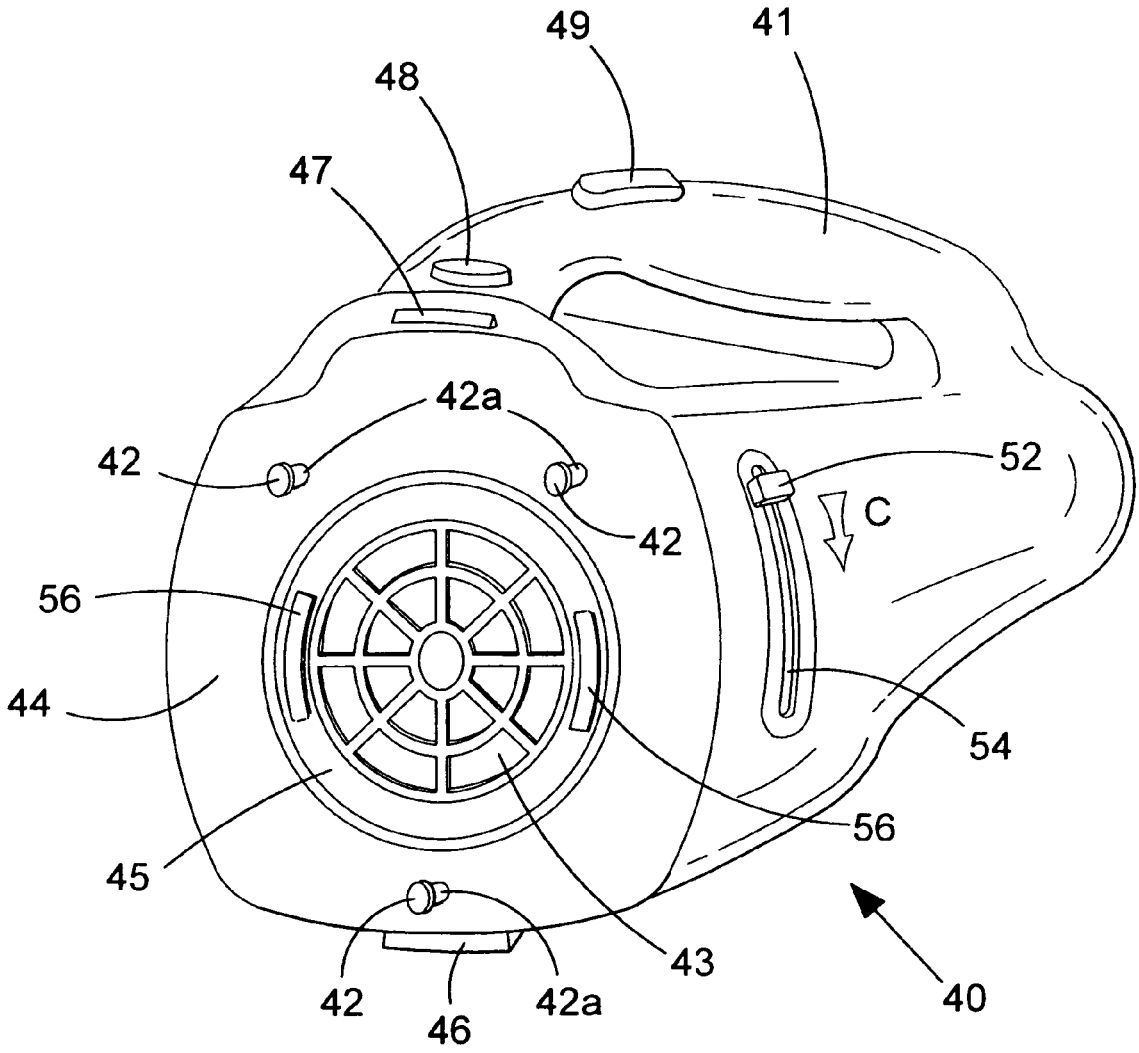
FIG. 3 is a perspective view of a motor housing of the held vacuum cleaner shown in FIG. 1.

Turning now to FIG. 3, it may be seen how coarse filter assembly 20 and nose cone 10 attach to motor housing 40. Lugs 42 on an end face 44 of motor housing 40 engage with holes 22 formed in the end flange 24 of coarse filter assembly 20, as mentioned previously. Holes 22 are so shaped that they each comprise both a larger portion having a diameter greater than a respective lug 42 and a smaller portion having a diameter smaller than lugs 42 but slightly larger than a respective stalk 42*a* on the end of which stalk each lug is formed. Thus, coarse filter assembly 20 containing fine filter assembly 30 may be attached to motor housing 40 by passing respective lugs 42 through the larger portion of each hole 22 and then twisting coarse filter assembly 20 until the smaller portion of each hole 22 surrounds a respective stalk 42*a* in a friction fit and is also prevented from being pulled away from motor housing 40 by the greater diameter of lugs 42. Coarse filter assembly 20 may be detached from motor housing 40 by twisting it in the opposite direction until each lug 42 is aligned with the larger portion of a respective hole 22 and reversing the operation of passing the lugs back again through the larger portion of the respective hole 22.

Nose cone 10 in turn attaches to motor housing 40 via a lip 46 formed on the underside of motor housing 40, which lip engages with a corresponding slot 16 formed in the lower part of nose cone 10 (see FIG. 1). A rim on the upper part of nose cone 10 also similarly engages with a spring-loaded latch 47 at the top of front face 44 of motor housing 40. Depressing a release button 48 mounted on the top of motor housing 40 allows a user to disengage nose cone 10 from motor housing 40 again, since release button 48 is mechanically connected to latch 47, such that depressing release button 48 causes latch 47 to withdraw from the upper rim of nose cone 10.

Motor housing 40 contains a fan and motor assembly for transporting air through the vacuum cleaner. As may be seen from FIG. 3, motor housing 40 comprises a clean air inlet 43 through which air is drawn into the motor housing by the fan during operation of the vacuum cleaner. Clean air inlet 43 is covered by a rotatable grille assembly 45 to prevent a user from gaining access to the fan and motor. Air drawn in through the inlet 43 during operation of the vacuum cleaner is then expelled from an outlet 430 located on the underside of motor housing 40, which is visible in FIG. 1. The motor housing further comprises a handle 41 on which is mounted a user operable on/off switch 49 for turning the motor on and off, as well as a filter cleaning lever 52 which is movable in a slot 54. Lever 52 is rigidly connected to rotatable grille assembly 45 within motor housing 40, such that moving lever 52 in the direction of arrow C shown in FIG. 3 causes grille assembly 45 to rotate in a clockwise direction and conversely, moving lever 52 in the opposite direction to arrow C causes grille assembly 45 to rotate anticlockwise.

Figure 4A:
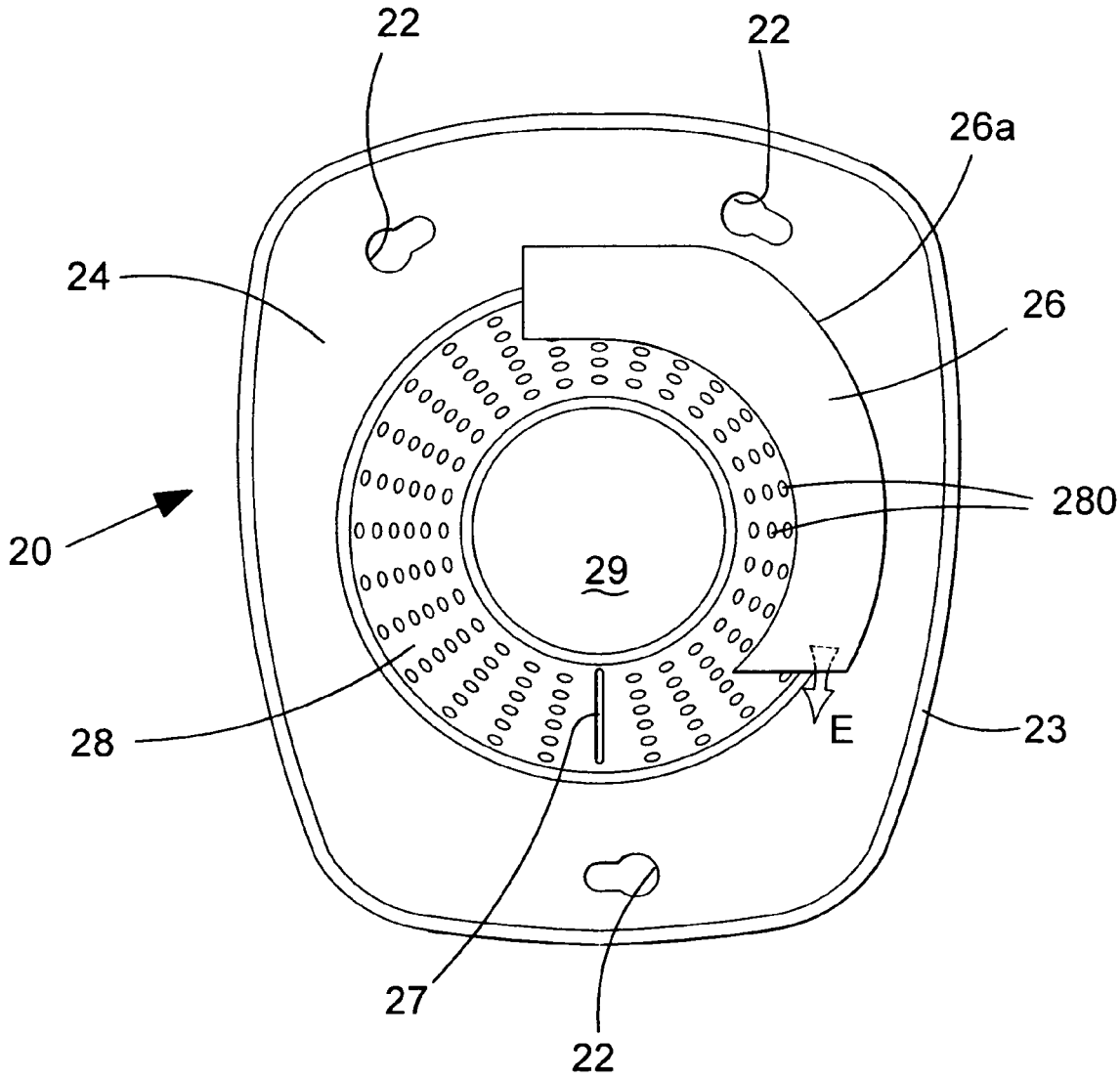
FIG. 4A is a plan view of the exterior of a coarse filter assembly of the held vacuum cleaner shown in FIG. 1.

The filtering and flow of dirty air through the vacuum cleaner will now be described. Looking firstly at FIG. 4A, this shows an end-on view of the exterior of coarse filter assembly 20. As may be seen, coarse filter assembly 20 has a frusto-conical shape, such that the area of an end face 29 of coarse filter assembly 20 is less than the area which coarse filter assembly 20 presents to clean air inlet 43 of motor housing 40. The outer rim of end flange 24 of coarse filter assembly 20 is also provided with a peripheral moulding 23. This is made of a resilient material such as rubber or a similar elastomer, whereby coarse filter assembly 20 forms an airtight seal with motor housing 40 when mounted thereto in the manner described above in relation to FIG. 3. As may also be seen, deflector 26 has an edge 26*a* which follows the contours of the interior of dust collection chamber 14, the gap visible at the top of FIG. 4A between edge 26*a* and peripheral moulding 23 being occupied by the duct formed in the roof of nose cone 10. However, as may also be seen from this drawing, deflector 26 does not completely surround the main body 28 of coarse filter assembly 20, but only approximately one third thereof. Thus dirty air exiting the duct from outlet 12 firstly passes behind deflector 26 as seen in FIG. 4A and then emerges in the direction of arrow E such that it is free to continue rotating in a clockwise fashion in front of deflector 26, thereby creating an overall helical swirl of dirty air around main body 28, which causes heavier particles of dust and dirt entrained therein to be thrown outwardly by centrifugal force towards the inner walls of nose cone 10. These particles then fall under gravity and gather in the bottom of dust collection chamber 14 and the partially cleaned air is sucked through a plurality of small holes 280 formed in main body 28 of coarse filter assembly 20.

Figure 4B:
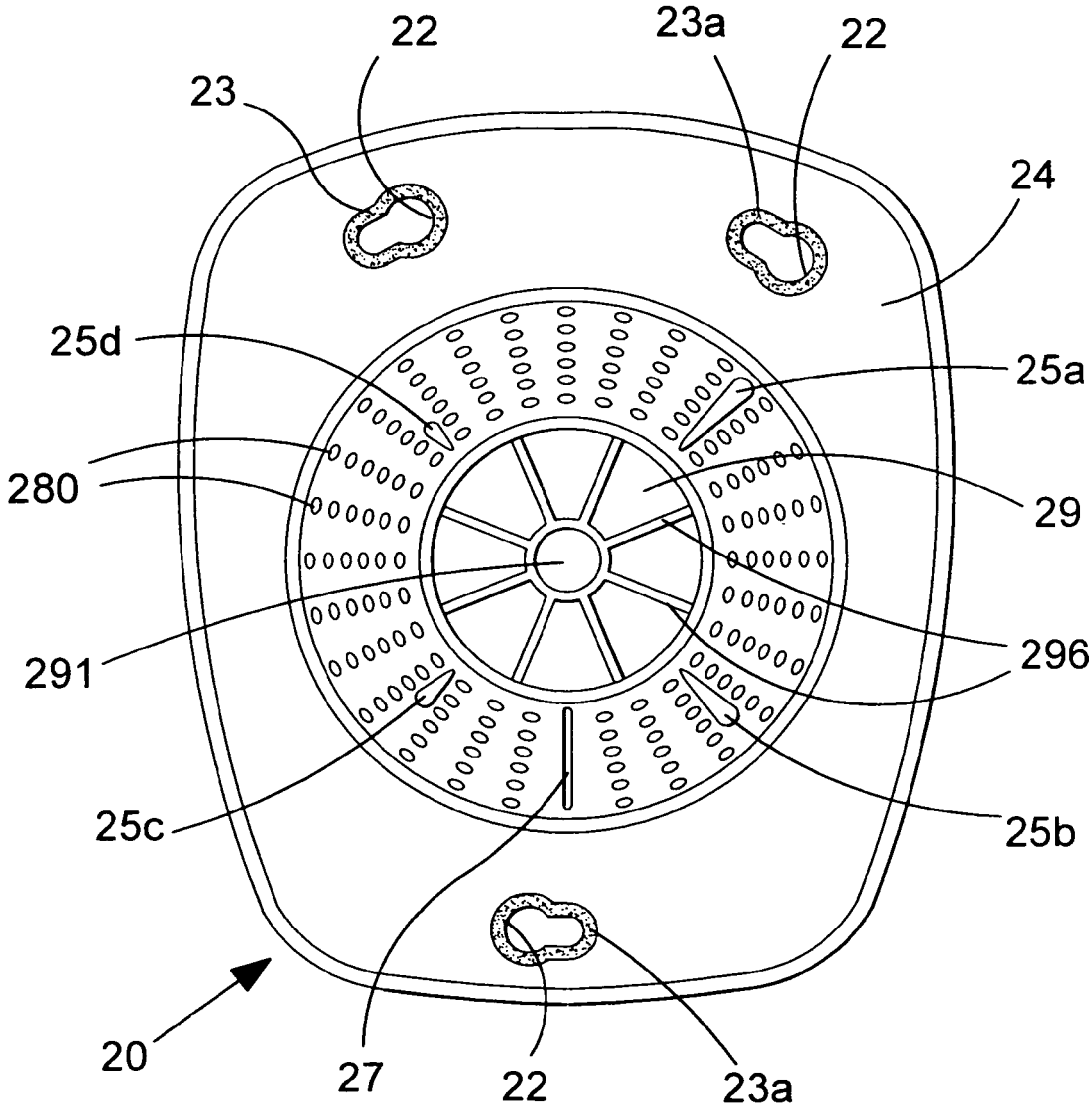
FIG. 4B is a plan view of the interior of the coarse filter assembly shown in FIG. 4A, seen from the opposite direction to FIG. 4A.

Turing now to FIG. 4B, this shows an end-on view of the interior of coarse filter assembly 20. As may be seen, the holes 22 for mounting the coarse filter assembly 20 to motor housing 40 are each surrounded by a respective moulding 23*a*. These mouldings are made of a resilient material such as rubber or a similar elastomer and are therefore squeezed between flange 24 and the front face 44 of motor housing 40 when the coarse filter assembly 20 is mounted thereto, thereby preventing leakage of dirty air through holes 22 from dust collection chamber 14 into motor housing 40. As can also be seen in FIG. 4B, the interior of coarse filter assembly 20 is also provided with a plurality of longitudinal vanes 25*a*, 25*b*, 25*c* and 25*d* projecting inwardly therefrom. These vanes create a gap between the interior of the coarse filter assembly 20 and the fine filter assembly 30 contained therein. However, each vane has a different height, such that vane 25*a* is taller than vane 25*b*, which in turn is taller than vane 25*c*, which itself is taller than the smallest vane 25*d*. These height differences prevent the gap between the coarse filter assembly 20 and the fine filter assembly 30 from being compartmentalised into regions separated by the vanes, but rather allow a swirl of air between the coarse filter assembly 20 and the fine filter assembly 30 in an anticlockwise direction as viewed in FIG. 4B (which is the same direction as the swirl around the outside of coarse filter assembly 20 described in relation to FIG. 4A), along a path of increasingly smaller cross-section. This tends to increase the pressure and therefore force the partially cleaned air within the coarse filter assembly 20 through the fine filter assembly 30 contained therein, which filters out the remaining smaller particles of dust and dirt entrained with the air. Any of these particles which fall under their own weight towards the bottom of the gap between the coarse filter assembly 20 and the fine filter assembly 30 are able to pass through a longitudinal slit 27 formed in the lower side of coarse filter assembly 20 and thence into dust collection chamber 14. Slit 27 is no greater in width than the diameter of holes 280, so as to prevent the passage of larger particles of dust and dirt in the opposite direction from dust collection chamber 14 back into the interior of coarse filter assembly 20.

Figure 5A:
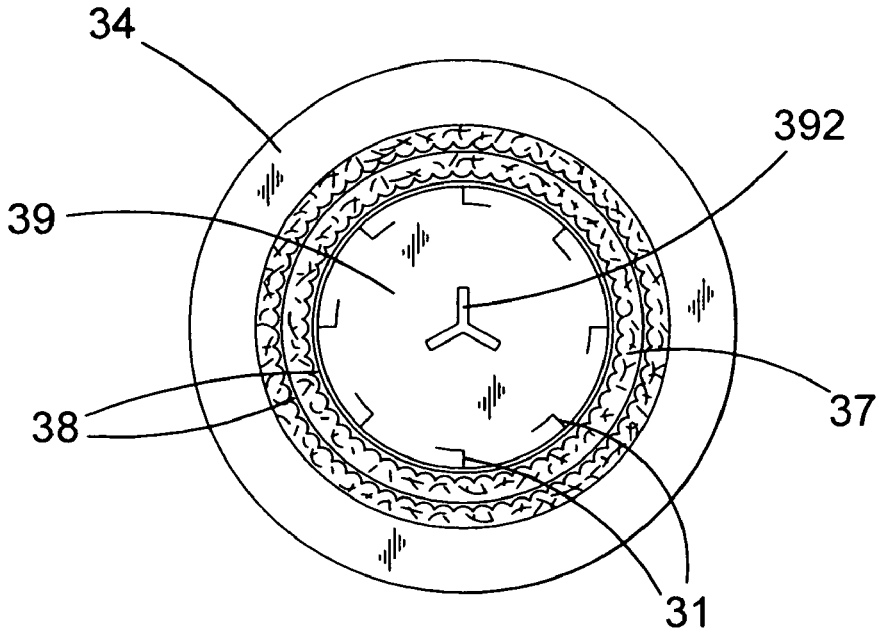
FIG. 5A is a plan view of the exterior of a fine filter assembly of the held vacuum cleaner shown in FIG. 1.

FIG. 5A shows an end-on view of the exterior of fine filter assembly 30. Like the coarse filter assembly 20, fine filter assembly 30 has a frusto-conical shape, such that the area of an end face 39 of fine filter assembly 30 is less than the area which fine filter assembly 30 presents to clean air inlet 43 of motor housing 40. As can also be seen from FIG. 5A, fine filter assembly 30 comprises an end flange 34, the width of which defines the gap between the interior of coarse filter assembly 20 and the exterior of fine filter assembly 30 and which accommodates vanes 25*a*, 25*b*, 25*c* and 25*d* therebetween. A moulding 392 projecting from end face 39 helps align the fine filter assembly 30 correctly within coarse filter assembly 20 by locating within a circular recess 291 formed on the interior of end face 29 of coarse filter assembly 20 (see FIG. 4B). As may best be seen in the side view of FIG. 5B, the conical surface of fine filter assembly 30 is defined by a fine filter material 37 which acts to filter out small particles of dust and dirt from air passing therethrough. Thus, the partially cleaned air swirling around the exterior of fine filter assembly 30 passes through fine filter material 37 and thence into the clean air inlet 43 of motor housing 40. The fine filter material 37 may be woven from polyethylene or a similar type of material and may also have a non-stick coating in order to help prevent the adherence and build-up of dust particles thereon. Fine filter material 37 is shaped and held in place by hoops 38 formed on the outer surface thereof and a plurality of longitudinal supporting ribs 35 on the inner surface thereof (see FIG. 5C), the ribs 35 and hoops 38 being thermally welded to fine filter material 37 during the manufacturing process.

Figure 5B:
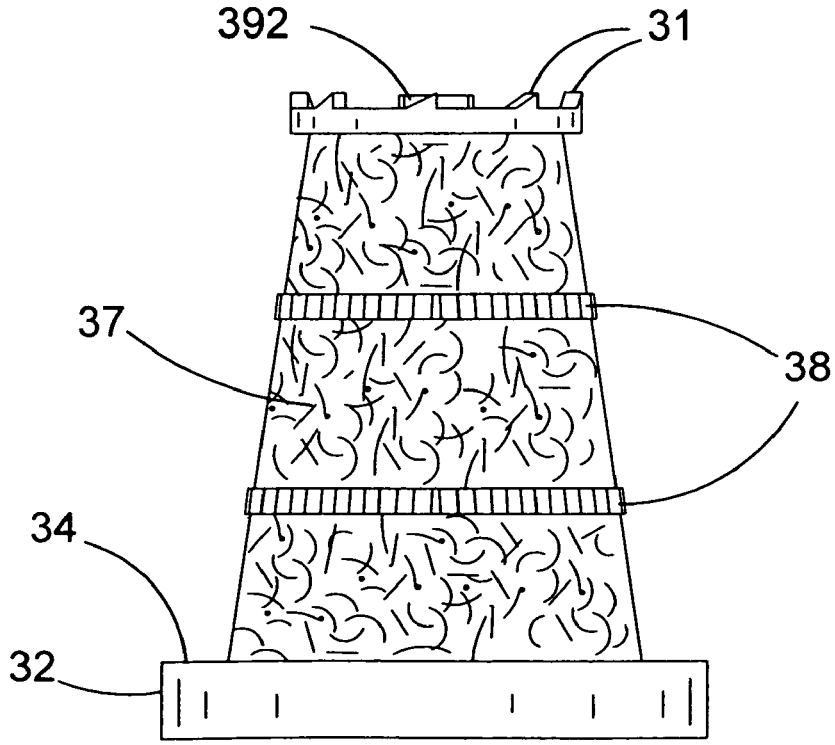
FIG. 5B is a side elevational view of the fine filter assembly shown in FIG. 5A.
Figure 5C:
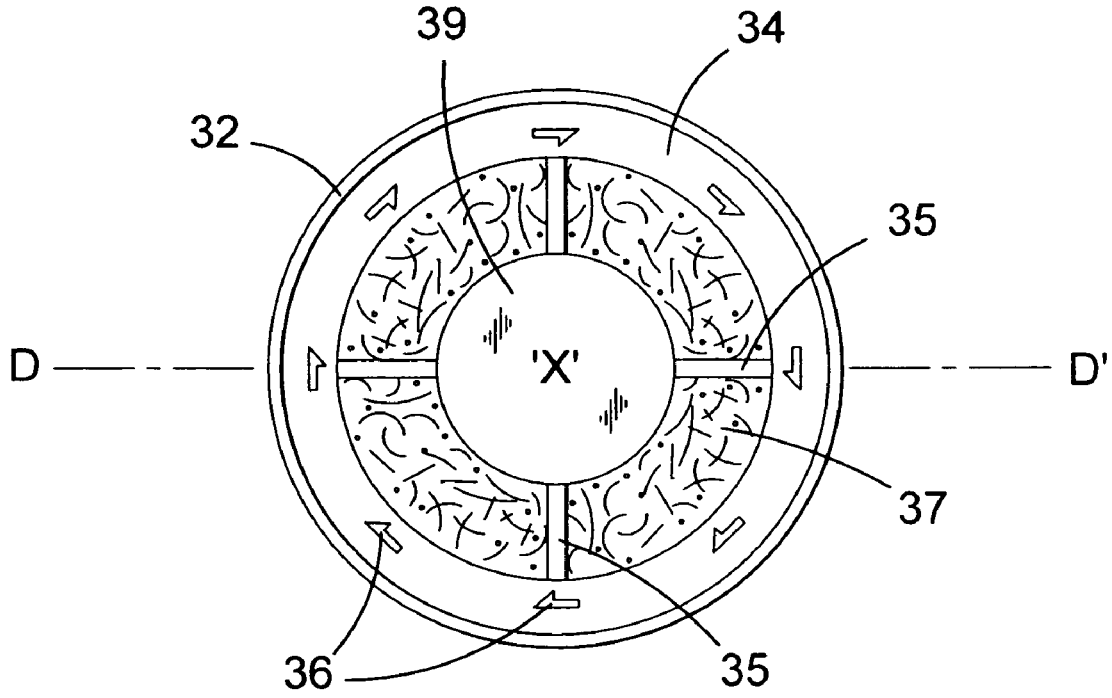
FIG. 5C is a plan view of the interior of the fine filter assembly shown in FIG. 5A, seen from the opposite direction to FIG. 5A.
Figure 5D:
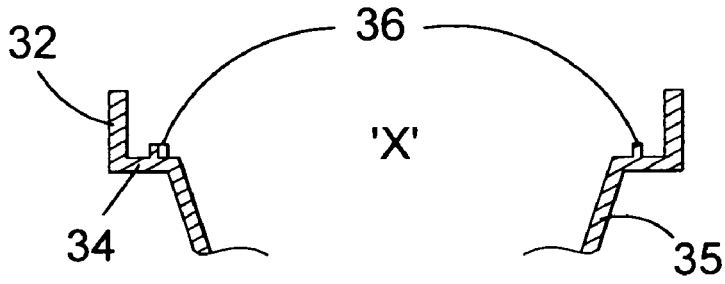
FIG. 5D is a partial cross-sectional view of the fine filter assembly shown in FIG. 5A along the line D-D' represented in FIG. 5C.
Figure 6A:
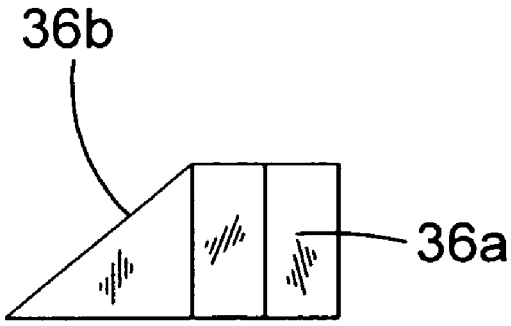
FIG. 6A is side elevational view of one of a plurality of teeth formed on an end flange of the fine filter assembly of FIG. 5A viewed from the location marked by the letter "X" in FIGS. 5C and 5D.
Figure 6B:
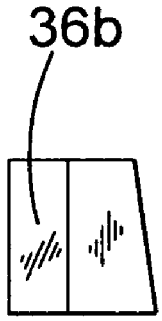
FIG. 6B is a rear elevational view of one of the plurality of teeth formed on the end flange of the fine filter assembly of FIG. 5A.
Figure 6C:
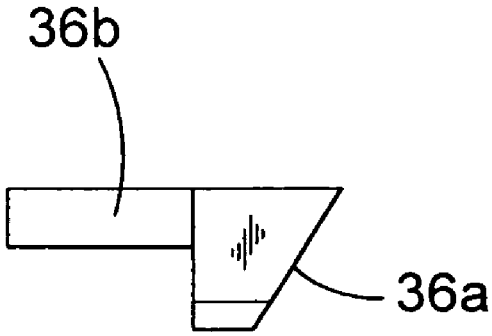
FIG. 6C is a plan view of one of the plurality of teeth formed on the end flange of the fine filter assembly of FIG. 5A.
Figure 6D:
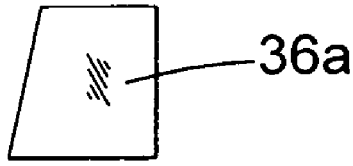
FIG. 6D is a front elevational view of one of the plurality of teeth formed on the end flange of the fine filter assembly of FIG. 5A.

As may also be seen in FIGS. 5A and 5B, the end face 39 of fine filter assembly 30 has a first set of teeth 31 formed in a ring around the circumference thereof. These teeth 31 have a triangular or ramp-shaped profile and abut against a corresponding set of radial ribs 296 formed on the inner surface of end face 29 of the coarse filter assembly 20 (see FIG. 4B). As shown in FIGS. 5C and 5D, the end flange 34 of fine filter assembly 30 also has a second set of teeth 36 formed in a ring thereon. As may best be seen in the partial cross-section of FIG. 5D, a rim 32 formed around the periphery of flange 34 means that the second set of teeth 36 are recessed into fine filter assembly 30. The teeth 36 each have a shape as represented in the series of drawings FIGS. 6A, 6B, 6C and 6D, which are respectively a side elevational view of one of the teeth when viewed from a location marked by the letter "X" in FIGS. 5C and 5D, a rear elevational view, a top plan view and a front view.

Figure 7A:
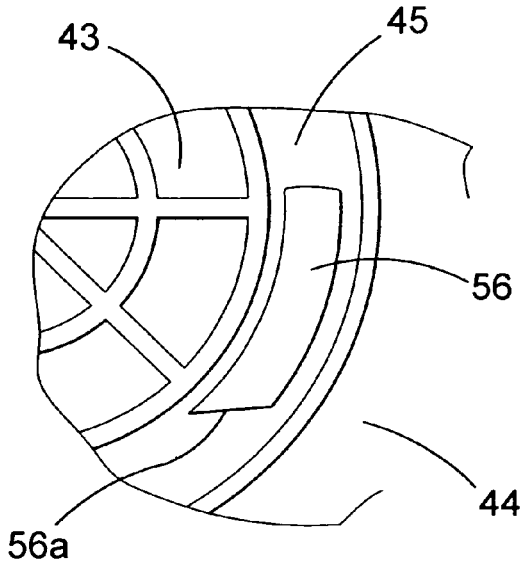
FIG. 7A is a plan view in close-up of part of an air inlet portion of the motor housing of FIG. 3 showing a ramp formed thereon.
Figure 7B:
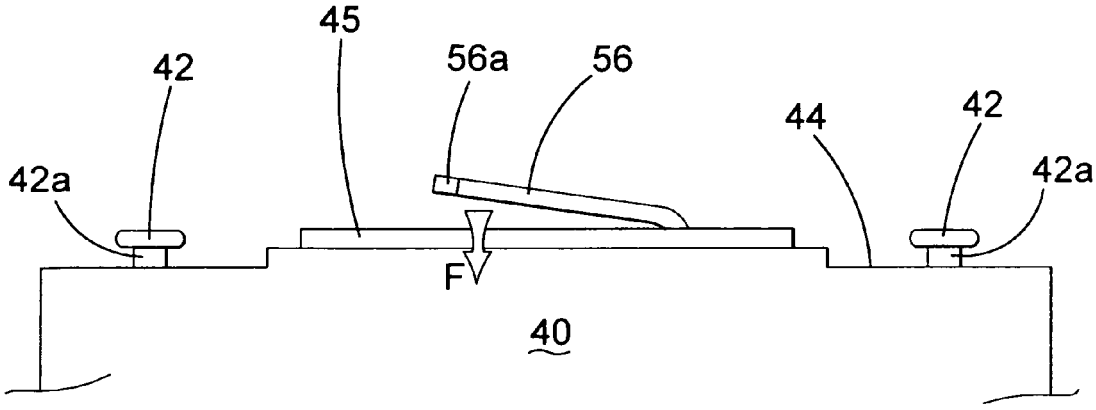
FIG. 7B is a side elevational view of a part of the motor housing of FIG. 3 showing the ramp of FIG. 7A in profile.

Both the first set of teeth 31 and the second set of teeth 36 are components of the filter cleaning mechanism, the operation of which will be described shortly. A further component of the filter cleaning mechanism is a series of serrations formed around the respective outer surfaces of each of the hoops 38 on the fine filter assembly 30. The final components of the filter cleaning mechanism not already described are shown in FIGS. 7A and 7B. These are a pair of ramps 56 formed on opposite sides of the circumference of the rotatable grille assembly 45. As can be seen in FIG. 7B, ramps 56 project outwardly from end face 44 of motor housing 40 into the annular recess created by rim 32 and flange 34 in fine filter assembly 30. Thus, when a user moves lever 52 in the direction of arrow C shown in FIG. 3, thereby causing grille assembly 45 to rotate in a clockwise direction, ramps 56 also rotate clockwise and an oblique end face 56*a* of each ramp 56 engages with an oblique end face 36*a* (see FIGS. 6A, 6C and 6D) of one of the second set of teeth 36 on flange 34. This pushes fine filter assembly 30 in a clockwise direction as well and causes the radial ribs 296 formed on the inner surface of end face 29 of the coarse filter assembly 20 to ride up the ramps of the first set of teeth 31. This compresses the fine filter assembly 30 slightly in a longitudinal direction within its elastic limit until the ribs 296 drop completely over the other side of the ramps of the first set of teeth 31. This allows the fine filter assembly 30 to spring suddenly back to its full, uncompressed length, thereby shaking dust particles adhering to the outside of fine filter material 37 therefrom. At the same time, vanes 25*a*, 25*b*, 25*c* and 25*d* rub against successive ones of the serrations formed around the outer surfaces of hoops 38, increasing the shaking of the fine filter assembly 30, but due to the different separations of successive teeth 31 on the one hand and successive serrations on the hoops 38 on the other, at different frequencies from each other, which improves the effectiveness of the filter cleaning operation in dislodging dust particles from the fine filter material 37. These two shaking actions continue until a user reaches the bottom of a down-stroke of lever 52 and the lever reaches the end of slot 54.

Next, when a use reverses the direction of lever 52 by moving it in the opposite direction to arrow C shown in FIG. 3, thereby causing grille assembly 45 to rotate in an anticlockwise direction, ramps 56 also rotate anticlockwise, are compressed slightly within their elastic limit in the direction indicated by arrow F in FIG. 7B and slide up an inclined face 36*b* (see FIGS. 6A, 6B and 6C) of a respective one of the second set of teeth 36 on flange 34. Fine filter assembly 30, on the other hand, is prevented from rotating anticlockwise about its longitudinal axis by abutment of the end faces of the first set of teeth 31 against the radial ribs 296 formed on the inner surface of end face 29 of the coarse filter assembly 20. The length of ramps 56 is such that a single up-stroke of lever 52 back to the top of slot 54 causes the ramps 56 to drop completely over the other side of the teeth 36 and brings their respective end faces 56*a* back into alignment with an oblique end face 36*a* of respective ones of the second set of teeth 36 on flange 34, thereby returning the filter cleaning mechanism to its starting position.

The invention claimed is:

1. A filter cleaning mechanism for a vacuum comprising:

a flexible first frame supporting a first filter material, the first filter material filtering dirt particles passing therethrough, the first frame having a first end surface with teeth thereon, a second frame having ribs on an end surface, the first frame positioned inside the second frame so that the first frame teeth are adjacent the second frame ribs, wherein as the first frame is rotated with respect to the second frame, the teeth contact the ribs and the first frame is compressed and uncompressed as it rotates.

2. The filter cleaning mechanism of claim 1, wherein the teeth have a sloped surface so that as the first filter rotates, the first filter is gradually compressed as the ribs slide up the sloped surface and suddenly uncompress when the ribs slide past the apex of the teeth.

3. The filter cleaning mechanism of claim 1, wherein the first frame and filter are generally cone-shaped.

4. The filter cleaning mechanism of claim 1, wherein the first frame has serrated hoops extending around its circumference that engage vanes on an interior surface of the second frame, wherein the hoops engage the vanes and agitate the first frame to remove dirt particles collected on the filter material as it is rotated.

5. The filter cleaning mechanism of claim 4, wherein the compression of the first frame is in a first direction and the agitation is in a second direction which is not parallel to the first direction.

6. The filter cleaning mechanism of claim 4, wherein the spacing of the teeth and the ribs is at a first frequency, and the spacing of the serrations on the hoop and the vanes is at a second frequency which is different then the first frequency.

7. The filter cleaning mechanism of claim 4, further comprising a lever manually slidable in a slot for rotating the first frame with respect to the second frame.

8. The filter cleaning mechanism of claim 7, wherein the lever is located on an exterior surface of the vacuum, the lever being mechanically linked to an interior projection that engages a second end of the first frame and rotates it relative to the second frame.

9. The filter cleaning assembly of claim 1 wherein the second frame has a second filter material and the first filter material prevents the passage of dirt particles smaller then the second filter material.

* * * * *